US012397833B2

(12) United States Patent
Piparsaniya

(10) Patent No.: US 12,397,833 B2
(45) Date of Patent: Aug. 26, 2025

(54) PREVENTION OF COLLISION BETWEEN TRAINS

(71) Applicant: Harsh Piparsaniya, Maharashtra (IN)

(72) Inventor: Harsh Piparsaniya, Maharashtra (IN)

(73) Assignee: SIEMENS MOBILITY, INC., New York, NY (US)

( * ) Notice: Subject to any disclaimer, the term of this patent is extended or adjusted under 35 U.S.C. 154(b) by 258 days.

(21) Appl. No.: 17/409,474

(22) Filed: Aug. 23, 2021

(65) Prior Publication Data

US 2022/0055668 A1 Feb. 24, 2022

(30) Foreign Application Priority Data

Aug. 24, 2020 (IN) ..... 202011036380

(51) Int. Cl.
*B61L 15/00* (2006.01)
*B61L 25/02* (2006.01)

(52) U.S. Cl.
CPC ..... *B61L 15/0018* (2013.01); *B61L 15/0027* (2013.01); *B61L 15/0054* (2013.01); *B61L 15/0062* (2024.01); *B61L 15/0081* (2013.01); *B61L 25/021* (2013.01); *B61L 25/025* (2013.01); *B61L 2205/04* (2013.01)

(58) Field of Classification Search
CPC .. B16L 3/008; B16L 15/0018; B16L 15/0027; B16L 15/0054; B16L 15/0081; B16L 2205/04; B16L 25/021; B16L 25/025
See application file for complete search history.

(56) References Cited

U.S. PATENT DOCUMENTS 2,762,913 A * 9/1956 Jepson ..... B61L 23/34 340/567
4,723,737 A * 2/1988 Mimoun ..... B61L 23/34 246/25
4,864,306 A * 9/1989 Wiita ..... B61L 25/023 340/991

(Continued)

FOREIGN PATENT DOCUMENTS

DE 4436983 A1 * 4/1996 ..... B16L 1/14
DE 19509696 A1 * 9/1996 ..... B61L 23/34

(Continued)

*Primary Examiner* — John M Zaleskas
(74) *Attorney, Agent, or Firm* — Lempia Summerfield Katz LLC

(57) ABSTRACT

A system and a method for preventing collision between a first train and a second train are provided. The system includes at least one first subsystem installed on a first train. The at least one first subsystem is configured to broadcast a message indicative of a status of the first train. The system further includes at least one second subsystem installed on a second train configured to selectively receive the broadcast message from the at least one first subsystem on the first train. The second subsystem determines the status of the first train by analyzing the broadcast message. An action to be performed at the second train for preventing a collision between the first train and the second train is determined based on the status of the first train. One or more instructions are generated for performing the action at the second train.

15 Claims, 5 Drawing Sheets

(56) References Cited

U.S. PATENT DOCUMENTS 5,420,883 A * 5/1995 Swensen ..... G01S 5/0009 375/138
5,437,422 A * 8/1995 Newman ..... B61L 27/20 246/5
5,574,469 A * 11/1996 Hsu ..... G01S 5/0027 342/357.34
5,720,455 A * 2/1998 Kull ..... B61L 15/0027 340/902
5,757,291 A * 5/1998 Kull ..... B61L 25/021 701/19
6,218,961 B1 * 4/2001 Gross ..... B61L 25/025 246/126
6,580,976 B1 * 6/2003 Belcea ..... B61L 27/20 340/988
7,578,485 B1 * 8/2009 Ohmstede ..... B61L 23/34 246/182 R
2003/0058131 A1 * 3/2003 Grisham ..... B61L 29/246 340/901
2004/0026575 A1 * 2/2004 Mindel ..... B61L 23/34 246/167 D
2004/0073366 A1 * 4/2004 Jones ..... B61L 23/041 701/301
2004/0155760 A1 * 8/2004 Grisham ..... B61L 29/246 340/435
2005/0107954 A1 * 5/2005 Nahla ..... G08G 1/164 701/19
2005/0133673 A1 * 6/2005 Sugita ..... B61L 27/40 246/167 R
2005/0275513 A1 * 12/2005 Grisham ..... B60Q 9/008 340/686.6
2006/0129287 A1 * 6/2006 Mindel ..... B61L 23/34 701/19
2006/0290478 A1 * 12/2006 Stull ..... B61L 25/023 340/425.5
2007/0282494 A1 * 12/2007 Moffitt ..... B60L 9/00 701/19
2008/0033605 A1 * 2/2008 Daum ..... B61L 27/16 701/19
2009/0109013 A1 * 4/2009 Kane ..... B61L 15/0054 340/466
2009/0177344 A1 * 7/2009 James ..... B61L 27/20 701/19
2010/0213321 A1 * 8/2010 Kane ..... B61L 25/025 246/167 R
2010/0268466 A1 * 10/2010 Amutham ..... B61L 23/00 701/301
2011/0108677 A1 * 5/2011 Asuka ..... B61L 23/14 246/27
2011/0172856 A1 * 7/2011 Kull ..... B61L 15/0027 246/219
2012/0296562 A1 * 11/2012 Carlson ..... B61L 25/025 701/301
2014/0014784 A1 * 1/2014 Brown ..... B61L 15/0027 246/167 D
2014/0183303 A1 * 7/2014 Kramer ..... B61L 15/009 246/167 R
2014/0209758 A1 * 7/2014 Kurita ..... B61L 3/00 246/2 S
2014/0229096 A1 * 8/2014 Carlson ..... B61L 23/34 701/300
2015/0060608 A1 * 3/2015 Carlson ..... B61L 25/021 246/122 R
2015/0329130 A1 * 11/2015 Carlson ..... B61L 3/125 246/122 R
2016/0039439 A1 * 2/2016 Fahmy ..... B61L 15/0081 701/20
2016/0046308 A1 * 2/2016 Chung ..... B61L 15/0027 701/20
2016/0096537 A1 * 4/2016 Bartek ..... B61L 15/0027 246/124
2016/0339934 A1 * 11/2016 Chung ..... B61L 25/025
2017/0349194 A1 * 12/2017 Chung ..... B61L 23/16
2018/0093685 A1 * 4/2018 Chung ..... B61L 25/025
2018/0105190 A1 * 4/2018 Becke ..... G08G 1/162
2018/0105192 A1 * 4/2018 Rahn ..... B61L 25/02
2018/0222503 A1 * 8/2018 Bartek ..... H04W 4/40
2018/0244292 A1 * 8/2018 Bailey ..... B61L 23/24
2018/0290673 A1 * 10/2018 Chu ..... G08G 1/123
2018/0362058 A1 * 12/2018 Carlson ..... B60T 8/1705
2019/0002002 A9 * 1/2019 Fahmy ..... B61L 15/0081
2019/0179034 A1 * 6/2019 Tubergen ..... B61L 25/025
2019/0196026 A1 * 6/2019 Craven ..... H04B 7/18545
2019/0300033 A1 * 10/2019 Carlson ..... B61L 3/125
2019/0308647 A1 * 10/2019 Dulmage ..... B61L 25/028
2020/0017133 A1 1/2020 Berger
2020/0086901 A1 * 3/2020 Kojima ..... B61L 23/34
2020/0122758 A1 * 4/2020 Dulmage ..... B61L 15/0027
2020/0180665 A1 * 6/2020 Hausmann ..... B61L 3/008
2020/0207388 A1 * 7/2020 Halowell ..... B61L 15/0054
2020/0406944 A1 * 12/2020 Tubergen ..... B61L 25/026
2022/0032980 A1 * 2/2022 Bailey ..... B61L 23/06
2022/0097744 A1 * 3/2022 Piparsaniya ..... B61L 15/0081
2022/0266878 A1 * 8/2022 Piparsaniya ..... B61L 27/04
2022/0410948 A1 * 12/2022 Ronse ..... B61L 15/0027
2023/0063525 A1 * 3/2023 Fernandes ..... B61L 15/0027
2023/0066917 A1 * 3/2023 Piparsaniya ..... B61L 15/0027
2023/0192164 A1 * 6/2023 Carlson ..... B61L 25/025 246/122 R

FOREIGN PATENT DOCUMENTS

EP 0958987 A2 * 11/1999
EP 3819187 A1 * 5/2021 ..... B61L 15/0027
JP 2016060339 A * 4/2016

* cited by examiner

PREVENTION OF COLLISION BETWEEN TRAINS

PRIORITY

This application claims the benefit of Indian Patent Application Number 202011036380, filed on Aug. 24, 2020, which is hereby incorporated by reference in its entirety.

FIELD

The present embodiments relate to managing operation of trains, and more particularly, relate to a system and method for preventing collision between trains.

BACKGROUND

Rail transportation is one of the most popular modes of transportation for movement of goods and passengers. Rail vehicles operating on a common route are managed typically through signaling systems. Such signaling systems are intended to prevent head-on collisions and to maintain a safe headway between rail vehicles running in the same direction. Block signaling systems such as moving block systems and fixed block systems are used for preventing collision between trains operating on a common route, by maintaining a safe distance between the trains. For example, in moving block system, the train position and a corresponding braking curve is continuously calculated by the trains and communicated to wayside equipment. Based on the train position and the braking curve, the wayside equipment further establishes a Movement Authority for the trains. The Movement Authority indicates a permission for a train to move to a specific location within the constraints of the infrastructure with supervision of speed. Such block signaling systems may also employ track circuits, communicatively coupled to the wayside equipment, to determine the train positions. However, communication failures associated with the wayside equipment or the track circuit lead to signaling errors in the block signaling system. On manually driven trains, the driver of the train manages the operation of the train based on visual information pertaining to the Movement Authority received from the wayside equipment. However, it is possible that the driver may fail to pay attention to the visual information, thus leading to violation of the Movement Authority. Such human errors or signaling errors may lead to catastrophic events such as a head-on collision, a near-head on collision, or a rear-end collision between trains.

SUMMARY AND DESCRIPTION

The scope of the present invention is defined solely by the appended claims and is not affected to any degree by the statements within this summary.

In light of the above, there exists a need for a fail-safe mechanism for preventing collisions between trains.

A system and method for preventing collision between a first train and a second train is disclosed. In one aspect, the system includes at least one first subsystem installed on the first train, where the at least one first subsystem is configured to generate broadcast messages indicative of a status of the first train, and at least one second subsystem installed on the second train. The at least one second subsystem is configured via executable instructions to selectively receive the broadcast message from the at least one first subsystem on the first train. The at least one second subsystem is further configured to determine the status of the first train by analyzing the broadcast message. The at least one second subsystem is further configured to determine an action to be performed at the second train based on the status of the first train, where the action is associated with preventing a collision between the first train and the second train. Further, the at least one second subsystem is configured to generate one or more instructions for performing the action at the second train.

In another aspect, the method includes selectively receiving a broadcast message from at least one first subsystem on a first train, by at least one second subsystem installed on a second train. The method further includes determining a status of the first train, by the at least one second subsystem, based on analysis of the broadcast message. The method further includes determining an action to be performed at the second train, by the at least one second subsystem, based on the status of the first train, where the action is associated with preventing a collision between the first train and the second train. The method further includes generating one or more instructions, by the at least one second subsystem, for performing the action at the second train.

DETAILED DESCRIPTION

Figure 1:
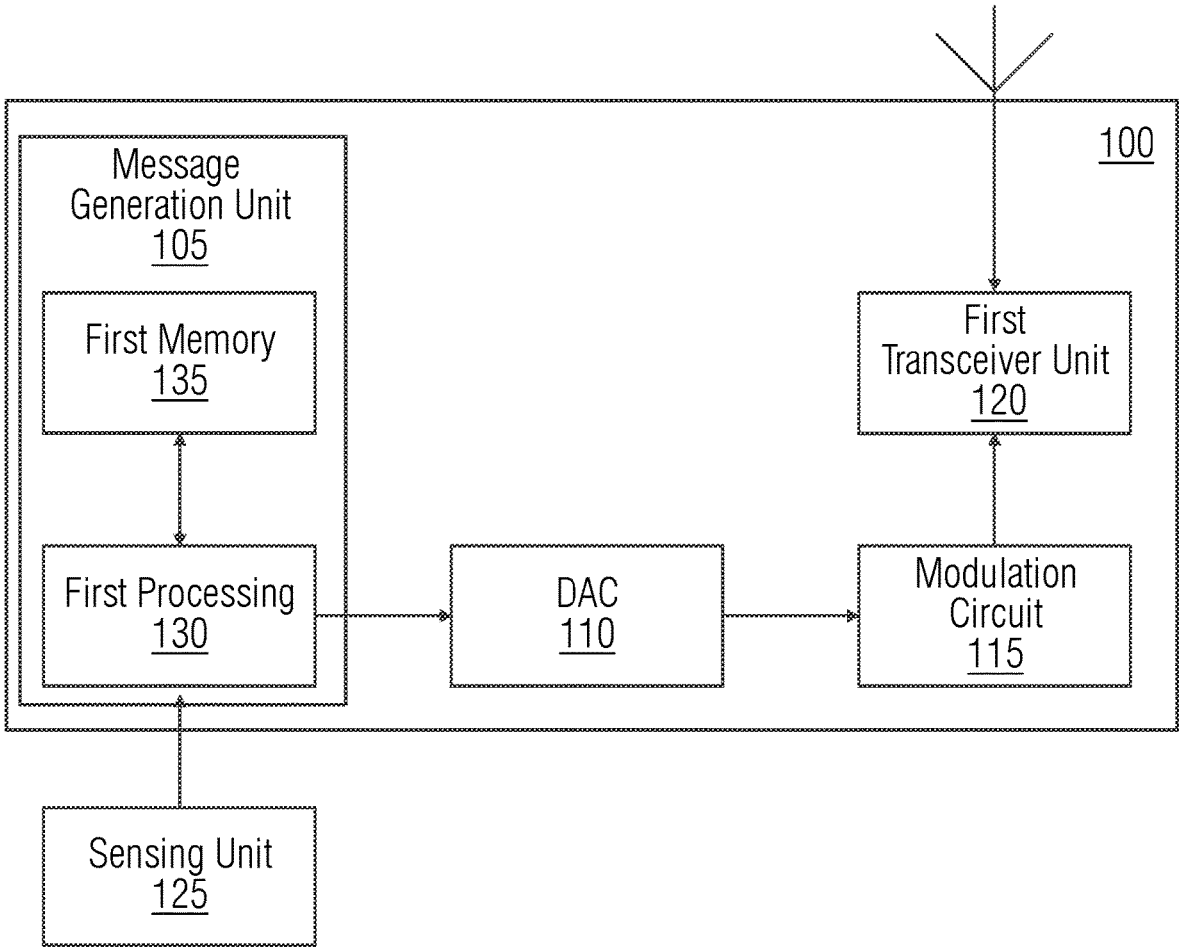
FIG. 1 illustrates a block diagram of a first subsystem for generating a broadcast message indicating a status of a train, in accordance with an embodiment.

Various embodiments are described with reference to the drawings, where like reference numerals are used in reference to the drawings. Like reference numerals are used to refer to like elements throughout. In the following description, numerous specific details are set forth in order to provide a thorough understanding of embodiments. These specific details need not be employed to practice embodiments. In other instances, well known materials or methods have not been described in detail in order to avoid unnecessarily obscuring embodiments. While the disclosure is susceptible to various modifications and alternative forms, specific embodiments thereof are shown by way of example in the drawings and will herein be described in detail. There is no intent to limit the disclosure to the particular forms disclosed. Instead, the disclosure is to cover all modifications, equivalents, and alternatives falling within the spirit and scope of the present invention.

FIG. 1 illustrates a block diagram of a first subsystem 100 for generating a broadcast message indicating a status of a train (not shown), in accordance with an embodiment. The first subsystem 100 includes a message generation unit 105, a digital to analog converter (DAC) 110, a modulation circuit 115, and a first transceiver unit 120. The message generation unit 105 is communicatively coupled to one or more sensing units 125. The one or more sensing units 125 are configured to sense various parameters associated the train.

In one embodiment, the one or more sensing units 125 are configured to sense at least one parameter associated with an integrity of the train. For example, the one or more sensing units 125 may include tilt sensors installed on one or more rail cars of the train to detect derailment of the rail cars. The one or more sensing units 125 may also include other sensors such as proximity sensors, installed between the rail cars, to detect accidental decoupling of the rail cars.

In another embodiment, the one or more sensing units 125 are configured to detect a real-time location of the train. For example, the one or more sensing units 125 may include a Global Positioning System (GPS) to detect the real-time location. In yet another aspect, the one or more sensing units 125 are configured to measure a real-time speed of the train. For example, the real-time speed is measured using a wheel speed sensor positioned on a wheel of the train. The wheel speed sensor is a specially adapted tachometer that measures a wheel speed of the train. In yet another embodiment, the real-time speed is measured using an accelerometer mounted on the train.

In yet another embodiment, the one or more sensing units 125 are configured to detect a braking status associated with the train. For example, the one or more sensing units 125 include a brake pipe sensing hose attached to a glad-hand coupler on a brake pipe of the train. The brake pipe sensing hose is configured to detect the braking status based on an air pressure within the brake pipe.

In yet another embodiment, the one or more sensing units 125 include at least one transmitting antenna and at least one receiving antenna located at extremities of the train. For example, the transmitting antenna may be located near an end of the train, and the receiving antenna may be located near a head of the train. The transmitting antenna may continuously emit radio-frequency signals of a predefined strength, and the receiving antenna measures a received signal strength (RSS) associated with the radio-frequency signals. Based on the RSS, a length of the train is computed in real-time. In one embodiment, the measurement of the length of the train based on the RSS helps in determining an integrity of the train. For example, the RSS reduces in case of a derailment or accidental decoupling of rail cars on the train, thereby indicating that the integrity of the train is compromised. In an alternate embodiment, the length of the train may also be determined based on GPS sensors located at the extremities of the train. In yet another embodiment, the length of the train may also be determined with the help of track circuits such as axle counters.

Further, sensor data or outputs from each of the one or more sensing units 125 are provided to the message generation unit 105, via a data acquisition unit (not shown). In an embodiment, the message generation unit 105 includes a first processing unit 130 and a first memory 135. The term 'first processing unit' 130, as used herein, may be any type of computational circuit, such as, but not limited to, a microprocessor, microcontroller, complex instruction set computing microprocessor, reduced instruction set computing microprocessor, very long instruction word microprocessor, explicitly parallel instruction computing microprocessor, graphics processor, digital signal processor, or any other type of processing circuit. The first processing unit 130 may also include embedded controllers, such as generic or programmable logic devices or arrays, application specific integrated circuits, single-chip computers, and the like. The first memory 135 may be non-transitory volatile memory and non-volatile memory. The first memory 135 may be coupled for communication with the first processing unit 130, such as being a computer-readable storage medium. The first processing unit 130 may execute instructions and/or code stored in the first memory 135 to generate broadcast messages based on the sensor data. More specifically, the message generation unit 105 is configured to process the sensor data to identify a current status corresponding to at least one parameter associated with the train. For example, the parameter may correspond to train integrity, braking status, and/or a geographical location. Based on the current status of the parameter, the broadcast message is generated. A variety of computer-readable instructions may be stored in and accessed from the first memory 135. The first memory 135 may include any suitable element for storing data and machine-readable instructions, such as read only memory, random access memory, erasable programmable read only memory, electrically erasable programmable read only memory, a hard drive, a removable media drive for handling compact disks, diskettes, magnetic tape cartridges, memory cards, and the like.

In the present embodiment, broadcast messages corresponding to a train integrity status, a braking status, and a location status are generated. It is possible to generate other types of broadcast messages that may be used to indicate various operational statuses of the train to another train.

Each of the broadcast messages are generated in the form of data packets. Each of the data packets includes a header section, a payload section, and a trailer section. In an embodiment, the header section may include a sequence number, a device identification number, and a broadcast type identifier. The sequence number is used for reordering of the data packets to retrieve the broadcast message at a second subsystem that receives the data packets. The device identification number is used to uniquely identify the first subsystem or the train. The broadcast type identifier may indicate a type of the broadcast message. The broadcast type identifier may be indicated by alphabets, numbers, or an alphanumeric series. For example, the broadcast type identifier '00' may correspond to train integrity status, the broadcast type identifier '01' may correspond to location status, and the broadcast type identifier '10' may correspond to braking status. The trailer section includes fields such as checksum or a secure key string, that are used for validating integrity of the broadcast message. The payload section is configured based on the type of the broadcast message.

In an example, if the broadcast message corresponds to train integrity status, the payload section includes a length of the train, a geographical location of the train, and a failure time of the train. The length of the train may be determined in real-time based on RSS measured at a receiving antenna as explained earlier. The geographical location of the train is a real-time geographical position of the train obtained from the GPS sensors. The failure time of the train is a timestamp corresponding to time at which the failure of the train is detected (e.g., by the one or more sensing units 125). For example, the time stamp may correspond to Dec. 5, 2019, 10:10 am. The failure may be one of derailment, accidental decoupling of rail cars, or loss of communication with the cab of the driver. The broadcast type identifier in the header section is set to '00'.

If the broadcast message corresponds to location status, the payload section includes the length of the train, the geographical location of the train, and a speed of the train. The speed of the train is obtained from the one or more sensing units 125 on the train. The broadcast type identifier in the header section is set to '01'.

If the broadcast message corresponds to braking status, the payload section includes the length of the train, the geographical location of the train, and a braking time. The braking time indicates a time duration associated with effecting an emergency brake. In general, the braking time is computed based on a braking curve associated with the train. The payload section further includes a timestamp associated with application of emergency brakes on the train. For example, if a driver of the train applies the emergency brake at time 3:15 pm and the train attains zero speed at 3:16 pm, the braking time is 1 minute, whereas the timestamp corresponds to 3:15 pm. The broadcast type identifier in the header section is set to '10'.

The broadcast message is further converted to an analog signal using the DAC 110. The modulation circuit 115 further modulates a carrier signal based on the analog signal using a modulation technique. The frequency of the carrier signal may be a radio frequency specific to communications in a railway network of a region. For example, in the United States, the radio frequency of 457 MHz may be used. However, any suitable frequency may be selected for the purpose of sending such broadcast messages. Non-limiting examples of modulation techniques include amplitude modulation, frequency modulation, phase modulation, phase shift keying, and pulse code modulation. Similar to the radio frequency, any modulation technique may be used based on the specifications or requirements of railway networks in a region. For example, certain regions may specify the use of Frequency Shift Keying (FSK). The modulated carrier signal is further amplified by the power amplifier (not shown) and broadcasted through the first transceiver unit 120. The first transceiver unit 120 may transmit the modulated carrier signal based on a suitable broadcasting technology. In an example, the broadcasting technology may be based on Wi-Fi communication.

Figure 2:
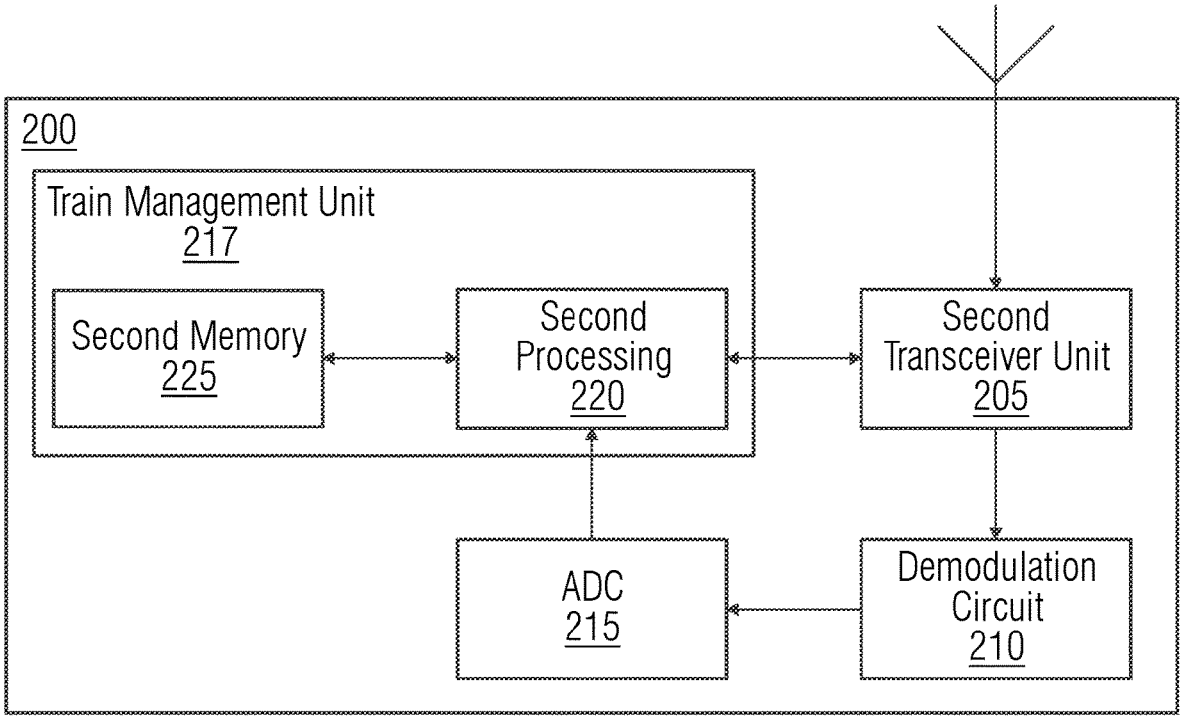
FIG. 2 illustrates a block diagram of a second subsystem configured for processing broadcast messages from the first subsystem, in accordance with an embodiment.

FIG. 2 illustrates a block diagram of a second subsystem 200 configured for processing broadcast messages from a first subsystem (similar to the first subsystem 100), in accordance with an embodiment. The second subsystem 200 includes a second transceiver unit 205, a demodulation circuit 210, an analog to digital converter (ADC) 215, and a train management unit 217.

The second transceiver unit 205 is configured to receive a broadcast message in the form of a modulated carrier signal from a first subsystem. Further, the demodulation circuit 210 demodulates the modulated carrier signal to generate an analog signal. The analog signal is further processed by the ADC 215. The ADC 215 may employ any known RF sampling technique to generate the broadcast message in digital format from the analog signal. Further, the broadcast message in digital format is provided as input to the train management unit 217. The train management unit 217 further includes a second processing unit 220 and a second memory 225.

The second processing unit 220 executes machine-readable instructions stored in the second memory 225 for preventing collision between a first train where the first subsystem is installed and a second train where the second subsystem is installed, in accordance with a method 300 described below. More specifically, the second processing unit 220 generates one or more instructions for implementing an action for preventing collision between the first train and the second train. The one or more instructions are transmitted to other equipment on the second train through the second transceiver unit 205. In an example, the equipment may include a braking system associated with the second train, and the one or more instructions may be associated with application of brakes for slowing down or stopping the second train. In another example, the equipment may include a display device, and the one or more instructions may be associated with displaying an information to a driver of the train. The equipment further executes the one or more instructions to prevent the collision between the first train and the second train. The equipment may also refer to another second subsystem located on the second train.

The term 'second processing unit' 220, as used herein, may be any type of computational circuit, such as, but not limited to, a microprocessor, microcontroller, complex instruction set computing microprocessor, reduced instruction set computing microprocessor, very long instruction word microprocessor, explicitly parallel instruction computing microprocessor, graphics processor, digital signal processor, or any other type of processing circuit. The second processing unit 220 may also include embedded controllers, such as generic or programmable logic devices or arrays, application specific integrated circuits, single-chip computers, and the like.

The second memory 225 may be non-transitory volatile memory and non-volatile memory. The second memory 225 may be coupled for communication with the second processing unit 220, such as being a computer-readable storage medium. The second processing unit 220 may execute instructions and/or code stored in the second memory 225. A variety of computer-readable instructions may be stored in and accessed from the memory 225. The second memory 225 may include any suitable elements for storing data and machine-readable instructions, such as read only memory, random access memory, erasable programmable read only memory, electrically erasable programmable read only memory, a hard drive, a removable media drive for handling compact disks, diskettes, magnetic tape cartridges, memory cards, and the like.

Figure 3:
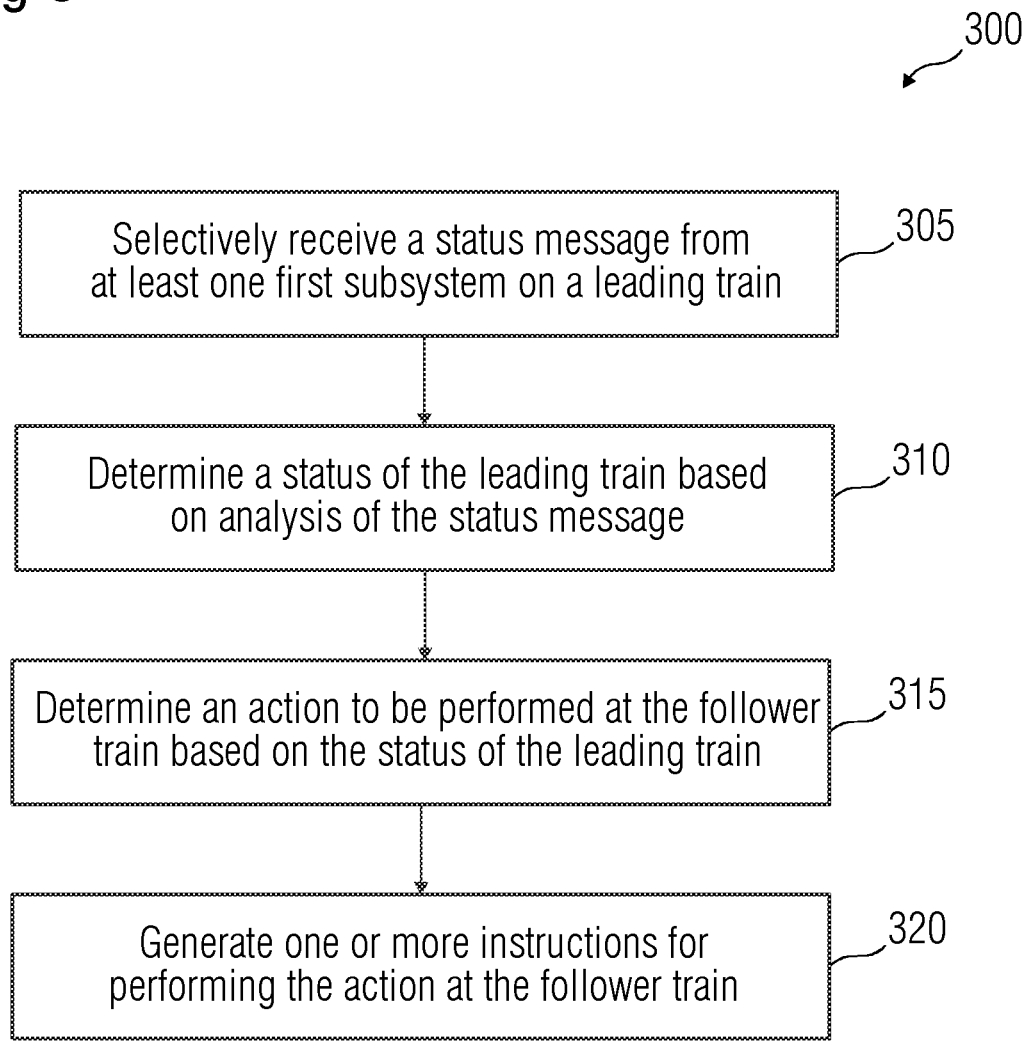
FIG. 3 depicts a flowchart of a method for preventing collision between the first train and the second train, in accordance with another embodiment.

FIG. 3, in conjunction with FIG. 2, depicts a flowchart of a method 300 for preventing collision between a first train and a second train, in accordance with an embodiment. The method includes acts 305 to 320, which may be implemented at the second subsystem 200 installed on the second train.

At act 305, a broadcast message from at least one first subsystem (similar to the first subsystem 100) on a first train is selectively received by at least one second subsystem installed on a second train. At first, the second subsystem identifies whether the first subsystem is installed on the same train as the second subsystem, based on the device identification number present in the broadcast message. If yes, the broadcast message is discarded. Otherwise, the second subsystem determines whether the geographical location in the broadcast message corresponds to a parallel track or the same track as the second train. If the first train and the second train are on parallel tracks, the second subsystem may discard the broadcast message. Otherwise, the second subsystem receives the broadcast message based on the corresponding broadcast type identifier. For example, the second subsystem is configured to receive only broadcast messages with broadcast type identifier '00'. In another example, the second subsystem is configured to receive only broadcast messages with the broadcast type identifier '01' or '10'. In one embodiment, the train management unit 217 instructs the second transceiver unit 205 to retransmit the received broadcast message to another subsystem based on the broadcast type identifier. For example, if the second subsystem is configured to receive broadcast messages with broadcast type identifier '01' or '10', broadcast messages with broadcast type identifier '00' may be retransmitted to another second subsystem on the second train for processing.

At act 310, a status of the first train is determined, by the at least one second subsystem, based on analysis of the broadcast message. For example, if the broadcast message is associated with train integrity, the second subsystem derives a length of the first train, a geographical location of the first train and a failure time associated with the first train from the broadcast message.

At act 315, an action to be performed at the second train is determined, by the at least one second subsystem, based on the status of the first train. The action is associated with preventing a collision between the first train and the second train. For example, the one or more instructions may be associated with application of emergency brakes, controlling a speed of the second train, initiating communication with a central server, or warning a driver of the second train.

In one example, if the broadcast message corresponds to train integrity, a failure time of the first train is determined from the broadcast message. Further, a headway or distance between the first train and the second train is calculated in real-time based on the geographical location of the first train and the failure time. Based on the headway and a speed of the second train, an estimated time of arrival (ETA) at the geographical location of the first train is computed. Based on the ETA, a new speed for the second train is computed using a predefined mathematical relation. The ETA is continuously computed based on broadcast messages that are continuously received from the first train. Consequently, when the ETA approaches a threshold time-limit (e.g., 2 minutes), the second subsystem may compute the new speed for the second train as zero. The new speed of zero indicates application of emergency brakes at the second train.

Similarly, if the broadcast message corresponds to braking status, a braking time of the first train is determined from the broadcast message along with a timestamp associated with the braking. Further, an ETA at the geographical location of the first train is computed based on the braking time and the timestamp associated with the braking. Based on the ETA computed, the second subsystem determines the action to be performed similar to the case of integrity status.

In another example, if the broadcast message corresponds to a location status of the first train, the second subsystem determines the headway between the first train and the second train in real-time based on the geographical location of the first train. Further, a probability of collision between the first train and the second train is estimated. For example, predefined mathematical relationships are used to estimate the probability of collision from the headway. Based on a value of the probability of collision, the second subsystem determines the action to be performed. For example, if the probability of collision is greater than a predefined value of, for example, 0.7, the action is determined as application of emergency brakes. Otherwise, the second subsystem may determine a new speed of the second train based on predefined rules. In an implementation, the speed may be calibrated based on the probability of collision and stored in the form of a calibration curve in a memory of the second subsystem. Further, the action is determined as reducing the speed of the second train to the new speed.

At act 320, one or more instructions, for performing the action at the second train are generated by the at least one second subsystem. The one or more instructions are associated with for example, actuating signals for application of the emergency brakes. In another example, the one or more instructions are associated with actuating signals for application of brakes on the second train such that the speed is controlled. In yet another example, the one or more instructions are associated with sending a message indicating the status of the first train to the central server.

Figure 4A:
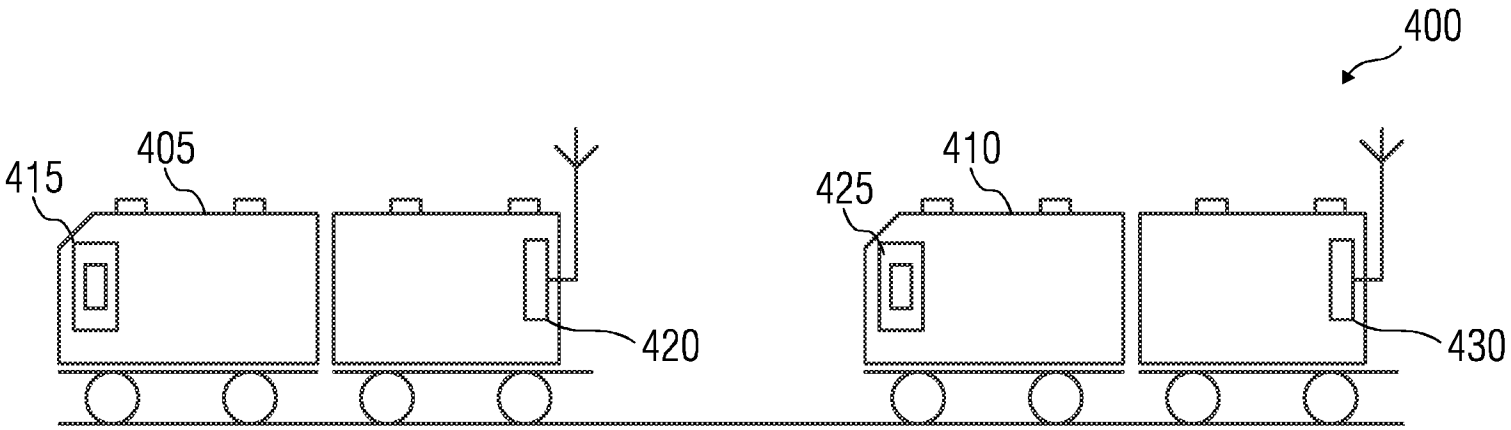
FIG. 4A illustrates an environment of a system for preventing collision between a first train and a second train when running on the same track, in accordance with an exemplary embodiment.

FIG. 4A illustrates an environment of a system 400 for preventing collision between a first train 405 and a second train 410 following the first train 405 on the same track, in accordance with an exemplary embodiment. Each of the first train 405 and the second train 410 includes an End of Train Telemetry (EOTT) system.

In the present embodiment, the EOTT system on the first train 405 includes a first Head-of-Train unit (HOT) 415 installed in a cab of the first train 405 and a first End-of-Train unit (EOT) 420 installed at a rear end of the first train 405, communicatively coupled to each other over a telemetry link. Further, the first EOT 420 may provide a train integrity status associated with the first train 405 to the first HOT 415 over the telemetry link. The first HOT 415 includes a Cab Display Unit (CDU) (not shown). The CDU may indicate the train integrity status associated with the first train 405 on a display based on data received from the first EOT 420. The first EOT 420 includes a High Visibility Marker (HVM) (not shown) and a Sensing and Braking Unit (SBU) (not shown). The HVM marker may include high intensity LED arrays that provides a visible indication of the presence of the first train 405 to the second train 410. The SBU includes a brake pipe sensing hose and an air braking system.

The first EOT 420 further includes a first subsystem configured to transmit broadcast messages corresponding to train integrity status, braking status, and location status, as explained earlier with reference to FIG. 1. Therefore, the terms first EOT 420 and the first subsystem may be hereinafter used interchangeably. In the present embodiment, the broadcast message for train integrity status is generated only when a failure is detected with respect to the first train 405. Similarly, the broadcast message for braking status is generated only when emergency brakes on the first train 405 are applied. The broadcast message for location status associated with the first train 405 is generated continuously or over predefined intervals of time irrespective of train integrity and braking status.

The EOTT system on the second train 410 includes a second HOT 425 installed in a cab of the second train 410 and a second EOT 430 installed at a rear end of the second train, communicatively coupled to each other over a telemetry link.

In the present embodiment, both the second EOT 430 and the second HOT 425 may include separate second subsystems each configured to process different types of broadcast messages. For example, the second subsystem on the second HOT 425 may be configured to process broadcast messages associated with train integrity status and braking status, while the second subsystem on the second EOT 430 may be configured to process broadcast messages associated with location status. Hereinafter, the terms second HOT 425 and the second EOT 430 are used to refer to the respective second subsystems. In the present embodiment, when a train integrity status or a braking status associated with the first train 405 is received, the second HOT 425 compute an ETA at a geographical location of the first train 405. Further, if the ETA is less than a threshold time-limit, the second HOT 425 generates instructions for the second EOT 430 to communicate the status of the first train 405 to a central server. Simultaneously, the second HOT 425 also generates instructions for actuating an emergency braking system of the second train 410. In an embodiment, the second HOT 425 may also generate instructions for displaying a warning message for the driver of the second train 410 on a CDU. The warning message may instruct the driver to manually reduce the speed of the second train 410.

The second EOT 430 may compute the probability of collision between the first train 405 and the second train 410. Based on the probability of collision computed, the second EOT 430 may compute a new speed for the second train 410. Further, the second EOT 430 generates instructions for controlling the speed of the second train 410. The generated instructions are further transmitted to the second HOT 425 in order to control the brake line pressure, in a coordinated manner. Further, the second HOT 425 is configured to identify broadcast messages intended for the second EOT 430, based on the broadcast type identifier and to retransmit the broadcast message to the second EOT 430. In one embodiment, if a transmission radius associated with the first EOT 420 does not reach the second EOT 430, the second HOT 425 receives and retransmits the broadcast message intended for the second EOT 430.

In another embodiment, the system 400 includes a single second subsystem included in the second HOT 425 for processing broadcast messages, as explained earlier using FIG. 2. For example, when a location status of the first train 405 is received, the second HOT 425 computes a probability of collision. Further, the second HOT 425 computes a new speed of the second train 410 such that the probability of collision between the first train 405 and the second train 410 is minimized or eliminated. Further, the second HOT 425 generates instructions to reduce the speed of the second train 410 to the new speed. The instructions are further provided to the second EOT 430 through an arming operation. The second EOT 430 further coordinates with the second HOT 425 to control a brake line pressure associated with a braking system of the second train 410, in order to bring down the speed of the second train 410 to the new speed. In another example, when a train integrity status or a braking status associated with the first train 405 is received, the second HOT 425 may compute an ETA at a geographical location of the first train 405. Further, if the ETA is less than a threshold time-limit, the second HOT 425 generates instructions for the second EOT 430 to communicate the status of the first train 405 to a central server. Simultaneously, the second HOT 425 also generates instructions for actuating an emergency braking system (not shown) of the second train 410. For example, the instructions may include actuating signals for actuating the emergency braking system. The second HOT 425 may also generate instructions for displaying a warning message for the driver of the second train 410 on a CDU. The warning message may instruct the driver to manually reduce the speed of the second train 410. It is to be understood by a person skilled in the art that a train may include both the first subsystem and the second subsystem, to prevent collision with other trains.

In another instance, the first train 405 and the second train 410 may run on the same track while heading towards each other. In this case, head-on collisions are prevented in a manner similar to prevention of rear-end collision as described above.

Figure 4B:
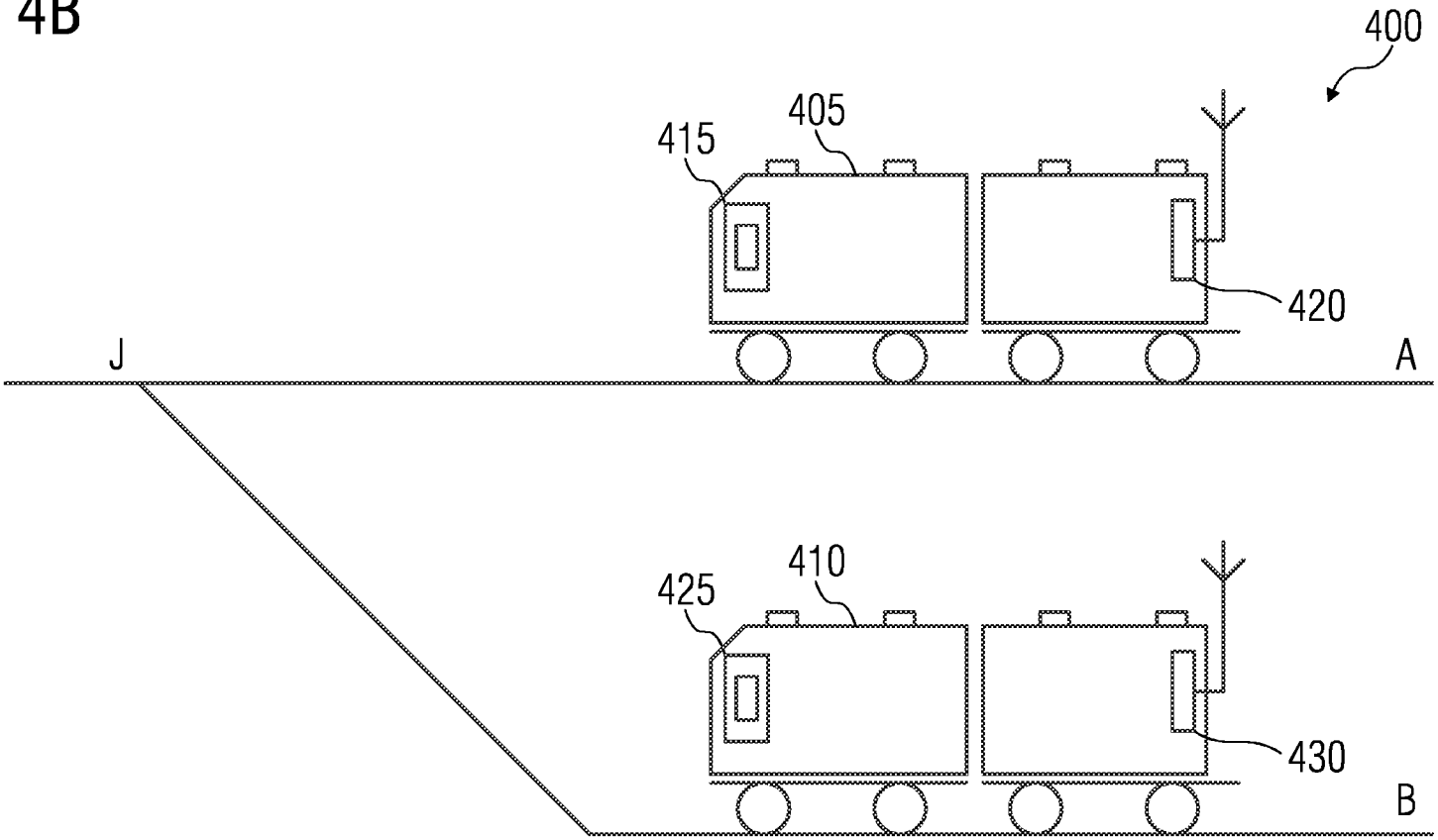
FIG. 4B illustrates an environment of the system for preventing collision between the first train and the second train when running on parallel tracks, in accordance with another exemplary embodiment.

FIG. 4B illustrates an environment of the system 400 for preventing collision between the first train 405 and the second train 410 when running on parallel tracks, in accordance with another exemplary embodiment. In the present example, the first train 405 and the second train 410 run on parallel tracks A and B, respectively. The second subsystems on each of the first train 405 and the second train 410 generate broadcast messages corresponding to their respective geographical locations. Based on the geographical location of the second train 410, the first HOT 415 on the first train 405 determines whether both the first train 405 and the second train 410 are headed towards a common juncture (e.g., juncture J) within a predefined time period of say (e.g., 10 minutes). If yes, a probability of collision between the first train 405 and the second train 410 is computed based on predetermined mathematical relations. If the probability of collision is greater than a predefined value of say 0.7, the first HOT 415 may transmit a message to the central server indicating the probability of collision. Similarly, the second HOT 425 may also compute the probability of collision and transmit another message to the central server indicating the probability of collision. Further, the central server may communicate a movement authority to each of the first train 405 and the second train 410, for example, based on predefined rules.

The present embodiments provide a fail-safe mechanism for prevention of collision between trains. More specifically, the present embodiments improve redundancy in existing signaling systems by facilitating communication of statuses between trains through broadcast messages, in addition to communication through wayside signaling units.

While embodiments of the present invention have been disclosed in exemplary forms, it will be apparent to those skilled in the art that many modifications, additions, and deletions may be made therein without departing from the spirit and scope of the invention and its equivalents, as set forth in the following claims.

The elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent. Such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

I claim:

1. A system comprising:

at least one first subsystem installed on a first train, wherein the at least one first subsystem is configured to transmit broadcast messages indicative of a status of the first train, headers of the broadcast messages including a device identification number; and at least one second subsystem configured via executable instructions to:

identify whether the at least one first subsystem is installed on a same train as the at least one second subsystem based on the device identification number included in the headers of the broadcast messages;

discard the broadcast messages when the at least one first subsystem is identified as being installed on the same train as the at least one second subsystem;

when the at least one first subsystem is identified as not being installed on the same train as the at least one second subsystem:

selectively receive the broadcast messages from the at least one first subsystem on the first train;

determine the status of the first train, the determination of the status of the first train comprising analysis of the broadcast messages;

determine an action to be performed at a second train based on the status of the first train, wherein the action is associated with prevention of a collision between the first train and the second train; and generate one or more instructions for performance of the action at the second train, wherein the at least one second subsystem is configured to selectively receive the broadcast messages based on a type associated with the broadcast messages, such that the at least one second subsystem is configured to receive only broadcast messages of the type, the type associated with the broadcast messages corresponding to a train integrity status, a location status, or a braking status, and wherein the type associated with the broadcast messages is identified by a broadcast type identifier within the headers of the broadcast messages, respectively, and payload sections of the broadcast messages are configured based on the type associated with the broadcast messages identified by the broadcast type identifier within the headers of the broadcast messages.

2. The system of claim 1, wherein the at least one first subsystem is associated with an end-of-train unit.

3. The system of claim 1, wherein the at least one second subsystem belongs to a group of second subsystems, and wherein the group of second subsystems comprise an end-of-train unit and a head-of-train unit.

4. The system of claim 1, wherein the at least one second subsystem is further configured to transmit the one or more instructions generated to one or more equipment onboard the second train.

5. The system of claim 4, wherein the one or more equipment are configured to execute the one or more instructions from the at least one second subsystem, to perform the action at the second train.

6. The system of claim 1, wherein the broadcast type identifier is an alphanumeric code in the headers of the broadcast messages, respectively.

7. The system of claim 1, wherein the broadcast type identifier includes all letters or all numbers.

8. The system of claim 1, wherein the type associated with a broadcast message of the broadcast messages corresponds to the train integrity status, and wherein the payload section of the broadcast message includes a length of the first train.

9. The system of claim 8, wherein the at least one first subsystem is further configured to:

determine the length of the first train; and determine the train integrity status of the first train based on the determined length of the first train.

10. The system of claim 1, wherein the broadcast messages are generated in the form of data packets, wherein the header of a data packet of the data packets includes a sequence number, and wherein the at least one second subsystem is further configured to reorder the data packets using the sequence number to retrieve the broadcast message.

11. A method comprising:

receiving a first broadcast message transmitted from at least one first subsystem installed on a first train, by at least one second subsystem, a header of the first broadcast message including a device identification number;

identifying, by the at least one second subsystem, the at least one first subsystem is installed on a same train as the at least one second subsystem based on the device identification number included in the header of the first broadcast message;

discarding, by the at least one second subsystem, the first broadcast message based on the identifying the at least one first subsystem is installed on the same train as the at least one second subsystem;

selectively receiving, by the at least one second subsystem, a second broadcast message, the second broadcast message being transmitted from at least one third subsystem installed on a second train, the second broadcast message being indicative of a status of the second train, a header of the second broadcast message including a device identification number;

identifying, by the at least one second subsystem, the at least one third subsystem as not being installed on a same train as the at least one second subsystem based on the device identification number included in the header of the second broadcast message;

determining, by the at least one second subsystem, a status of the second train based on analysis of the second broadcast message;

determining, by the at least one second subsystem, an action to be performed at the first train based on the status of the second train, wherein the action is associated with preventing a collision between the first train and the second train; and generating, by the at least one second subsystem, one or more instructions for performing the action at the first train, wherein selectively receiving the second broadcast message from the at least one third subsystem installed on the second train comprises selectively receiving the second broadcast message from the at least one third subsystem installed on the second train in response to the identifying of the at least one third subsystem not being installed on the same train as the at least one second subsystem, wherein selectively receiving the second broadcast message comprises selectively receiving the second broadcast message based on a type associated with the second broadcast message, such that the at least one second subsystem is configured to receive only broadcast messages of the type, the type associated with the second broadcast message corresponding to a train integrity status, a location status, or a braking status, and wherein the type associated with the second broadcast message is identified by a broadcast type identifier within the header of the second broadcast message, and a payload section of the second broadcast message is configured based on the type associated with the second broadcast message identified by the broadcast type identifier within the header of the second broadcast message.

12. The method of claim 11, wherein the at least one first subsystem is an end-of-train unit.

13. The method of claim 11, wherein the at least one second subsystem belongs to a group of second subsystems, and wherein the group of second subsystems comprise an end-of-train unit and a head-of train unit.

14. The method of claim 11, further comprising:

transmitting, by the at least one second subsystem, the generated one or more instructions to one or more equipment onboard the second train.

15. The method of claim 14, further comprising:

executing, by the one or more equipment, the one or more instructions from the at least one second subsystem to perform the action at the second train.

* * * * *